United States Patent [19]

Riedel

[11] 4,078,826

[45] * Mar. 14, 1978

[54] SKI BRAKE WITH INCREASED RESILIENCY BETWEEN BRAKE ACTUATOR AND BRAKE BLADE

[75] Inventor: Tilo Riedel, Eching, Germany

[73] Assignee: S.A. Etablissements Francois Salomon & Fils, Annecy, France

[ * ] Notice: The portion of the term of this patent subsequent to Nov. 2, 1993, has been disclaimed.

[21] Appl. No.: 665,790

[22] Filed: Mar. 10, 1976

Related U.S. Application Data

[63] Continuation of Ser. No. 557,476, March 12, 1975, Pat. No. 3,989,271.

[30] Foreign Application Priority Data

| | | |
|---|---|---|
| Mar. 15, 1974 | Germany | 2412623 |
| Jul. 26, 1974 | Germany | 2436155 |
| Feb. 20, 1975 | Germany | 2507371 |

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,433,494 | 3/1969 | Hinterholzer | 280/605 |
| 3,715,126 | 2/1973 | Schwarz | 280/605 |
| 3,909,024 | 9/1975 | Salomon | 280/605 |
| 3,989,271 | 11/1976 | Riedel | 280/605 |

FOREIGN PATENT DOCUMENTS

| | | | |
|---|---|---|---|
| 144,403 | 1/1936 | Austria | 280/605 |

*Primary Examiner*—David M. Mitchell
*Attorney, Agent, or Firm*—Karl F. Ross

[57] ABSTRACT

A ski brake has a main spring element mounted upon the upper surface of a ski and resiliently biased into an operative position when the ski is released from the ski boot to bring into play at least one brake element, e.g. a blade. In order to protect the brake against impact with stones or the like, an additional spring element is provided between the actuator, which includes a pivotal member received in a mounting plate on the upper surface of the ski, and the blade or brake element so that the latter can yield on impact while retaining its braking function to prevent free flight of the ski.

11 Claims, 5 Drawing Figures

SKI BRAKE WITH INCREASED RESILIENCY BETWEEN BRAKE ACTUATOR AND BRAKE BLADE

CROSS-REFERENCE TO RELATED APPLICATION

This application is a continuation-in-part of my copending application Ser. No. 557,476 filed Mar. 12, 1975 and entitled "AUTOMATIC BRAKE FOR SKI" now U.S. patent No. 3,989,271 issued November 2, 1976.

FIELD OF THE INVENTION

The present invention relates to a device for braking the free flight of a ski upon release of the ski from a ski boot and, more particularly, to a brake of this type which remains functional upon impact of the brake element with a foreign body.

BACKGROUND OF THE INVENTION

As described more fully in the above-identified application, a ski which is released from a ski boot on a slope can engage in free flight and, at high speeds, poses a danger to other skiers. For this reason it has been proposed to provide a ski with an automatic brake which is retained in its inoperative position by an application of the ski boot against a ski, e.g. against a spring force tending to bias an actuator into an operative position. The actuator may be engaged by the toe or heel of the ski boot when the latter is properly received in the ski binding.

The actuator is generally provided with one or two brake elements which are constituted as blades and swing from their inoperative positions in which they permit ordinary skiing into operative positions in which they engage the ground and prevent free flight of the ski when the actuator is released by the ski boot.

Such devices are termed hereinafter generically as ski brakes and generally have an actuator which is biased under a primary spring force from the inoperative position toward the operative position, in a mounting plate which can be affixed to the upper surface of the ski.

In one such ski brake, which is mounted behind the binding in a bearing or journal arrangement, the pivot axis includes an acute angle with the longitudinal axis of the ski and the basic spring force is generated by a torsion spring which acts upon a blade-like brake element.

In another conventional construction, leaf springs are secured at their forward ends to the ski and at their rearward ends tend to bend upwardly when they are unloaded. Upon loading by the ski boot, these spring elements are urged toward the upper surface of the ski to swing the blades into positions generally parallel to the ski edges as described in Austrian Pat. No. 299,036. Other ski brakes are described in Austrian Pat. No. 280,867 and 210,804 although these devices are somewhat more remote from the present invention than the prior-art devices described above and hence require no detailed discussion. Austrian Pat. No. 305,844 describes a ski brake having a spring which, upon release of an actuator, rotates a shaft extending transverse to the ski, about the shaft axis to bring the blade into play.

German published application (Offenlegungsschrift) No. 2,417,279 describes a ski brake which is mounted by a support plate on the upper surface of the ski. In one recess of this support plate, a round-cross-section wire is pivotally journaled and is formed as a pivot shaft. One end of the circular-cross-section wire forms a brake spur while another region of the wire is bent into a retaining hoop, the free end of the hoop being formed as a second shaft journaled in a further recess of the support plate. It is important in this construction that the two journaling recesses in the support plate be exactly parallel, a factor which increases the fabrication cost and causes differences with respect to mounting or operation if not fulfilled. These two journalling recesses impart an elastic prestress to the circular-section wire so that the braking spur automatically springs into the operative position when the wire is released by the ski boot.

OBJECTS OF THE INVENTION

It is the principal object of the present invention to provide a ski brake which extends the teachings of my above-identified copending application.

It is another object of the invention to provide an improved ski brake whereby disadvantages of earlier systems may be avoided.

Still another object of the invention is to protect a ski brake against impact with foreign objects.

It is a further object of the invention to improve the transition between the brake element or blade of a ski brake and its spring-loaded actuator so that more effective braking is obtained obtained under a wide variety of environmental conditions and even in the presence of various hazards.

SUMMARY OF THE INVENTION

These objects and others which will become apparent hereinafter are attained in accordance with the present invention, in a ski brake which is preferably of the stirrup shape described in the above-identified copending application with a pair of brake elements or blades which straddle the opposite edges of the ski in the operative position and which consist of a wire bent into a U-shape and distorted upon depression against the surface of the ski by the ski boot so as to provide the primary prestress biasing the brake elements into their operative position, but which can use other types of actuators, wherein between the primary spring-biased actuator which is movably mounted on the ski and the brake element or blade, there is provided at least one further elastic element (preferably a spring) whose spring effect is superimposed upon the primary spring action and reduces the maximum spring force which is applied to the primary spring element.

This arrangement ensures that, for example with a sudden impact of the brake element or blade against a foreign object, e.g. a stone or the like, that an overload will not be applied to the basic spring system so that the normal brake operation will be adversely affected.

Assume a rigid connection between the actuator and the brake blade, i.e. a system in which a transition elastic system according to the invention is not provided. When the primary spring is in its fully stressed condition, an impact of this nature may increase the primary spring force and overload the brake, e.g. causing damage thereto or permanent deformation of the actuator or primary spring element.

With the system of the present invention, however, such impacts are absorbed by yielding at the secondary spring element or elastic member. Consequently, the second elasticity enables the braking effect, because the brake element can be more responsive to environmental conditions, to be markedly improved.

BRIEF DESCRIPTION OF THE DRAWING

The above and other objects, features and advantages of the present invention will become more readily apparent from the following description, reference being made to the accompanying drawing in which.

SPECIFIC DESCRIPTION

In all of the embodiments described below it should be noted that the point of the invention is the transition between the actuator and the blade element and that other aspects of the ski-brake construction, its mounting plate, the use of a toggle arrangement and even the blade construction are fully disclosed in the above-identified application which is hereby included by reference. Only the elements germane to the present improvement and the operation of such elements have been described here.

Figure 1:
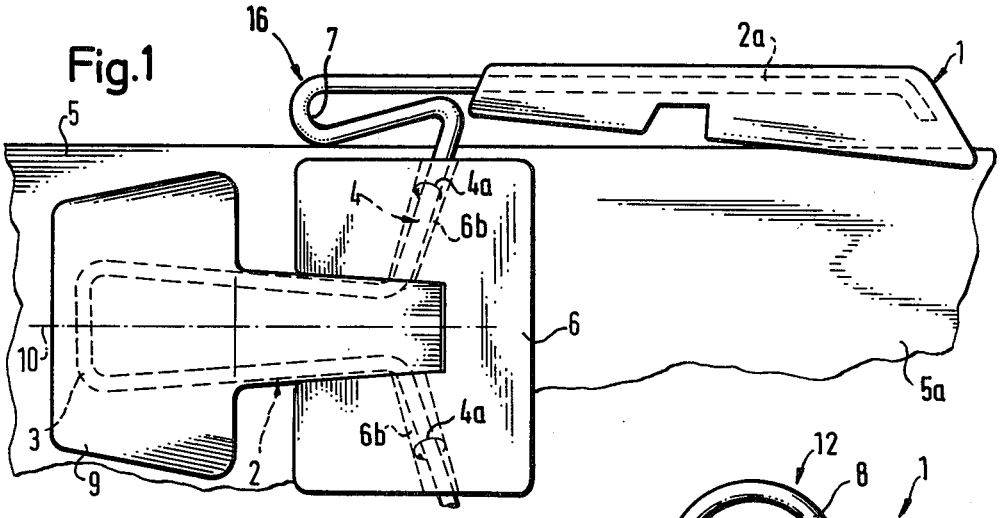
FIG. 1 is a plan view of a portion of a ski brake according to the invention, showing the blade on only one side thereof, it being understood that a similar blade is provided along the other longitudinal edge of the ski as well.

In FIG. 1 I have shown a ski brake for a ski 5 which has, mounted upon the upper surface 5*a* thereof, a plate 6 formed with recesses 6*a* and 6*b* in which a pair of outwardly and downwardly diverging pivot portions 4 of a stirrup-shaped spring wire 4 are received.

The spring wire 2 has an elongated loop-shaped bight 3 which lies in one plane, the offset portions 4 projecting from this plane. A tread plate 9 is pivotal on the mounting plate 6 and bears upon the bight 3 of the stirrup-shaped member 2. When the bight 3 is depressed toward the surface 5*a* of the ski, e.g. by stepping with the ski boot upon the tread plate 9, the offset portions 4 are rotated in the counterclockwise sense represented by the arrows 4*a* to swing a pair of blade-shaped brake elements 1 upwardly to lie along the longitudinal edges of the ski generally parallel to the surface 5*a*.

Since the offset portions 4 are not coplanar with the bight 3, however, and are confined in the recesses 6*a* and 6*b*, the depression of the bight applies a primary spring force which tends to swing the bight upwardly and hence biases the offset portions 4 for rotation in the opposite sense, thereby swinging the brake elements 1 downwardly into their operative position from their inoperative position illustrated as described in the aforementioned copending application.

In their operative position the brake elements or blades 1 straddle the ski and project downwardly below the snow-engaging surface of the ski to brake free flight of the latter.

In FIG. 1 the transition between the actuator 3, 4 and the blade 1 is formed by an elongated loop 7 of the spring wire 2 which provides an additional elastic effect. As can be seen from FIG. 5, a similar elastic effect can be obtained when, instead of the loop 7, a spiral or like-shaped bend 8 is provided at the transition region. The loop extends into a wire portion 2*a* which can be embedded in the blade 1. The additional spring element in FIG. 1 is represented at 16 and in FIG. 5 at 12.

Figure 5:
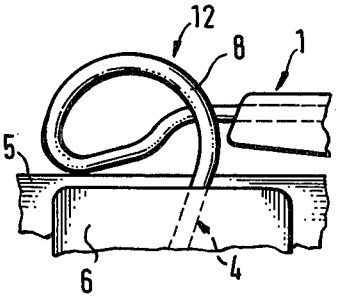
FIG. 5 is a detail view of an alternative to the secondary spring construction of the embodiment of FIG. 1.

The systems of FIGS. 1 and 5 function similarly as described, it being noted that any impact upon the blade is cushioned by deformation of the additional spring element 16 or 12 to reduce the force applied to the primary spring element 3, 4 of the actuator 2, 9.

Figure 2:
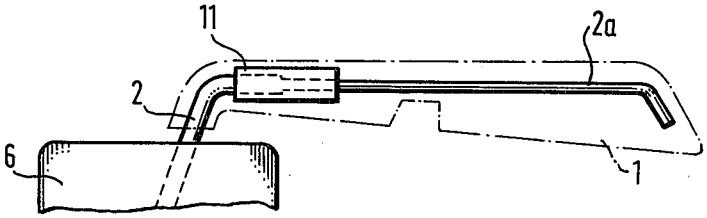
FIG. 2 is a fragmentary plan view showing a ski brake in which the secondary elastic element is a wire of reduced cross-section.

A further embodiment is shown in FIG. 2 in which the additional spring element is formed by a continuation sleeve 11 securing the thin wire portion 2*a* embedded in the blade 1 to the stirrup-shaped member 2. Sleeve 11 and thin wire 2*a* both contribute resiliency to the system and the sleeve 11 is preferably of an elastic material such as rubber. The portion 2*a* and member 2 have different moduluses of elasticity.

Figure 3:
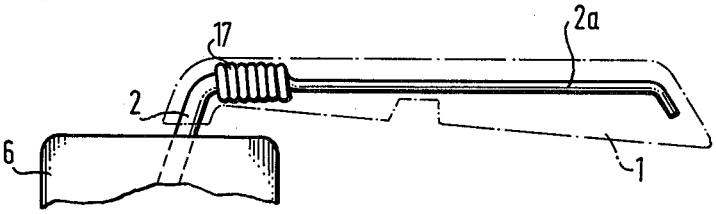
FIG. 3 is a fragmentary plan view of a system in which the secondary spring element is a thin wire connected by a coil spring to the thicker wire of the actuator.

In the embodiment of FIG. 3 the thin wire 2*a* is formed at one of its free ends with a coil spring 17 which is fitted over one tightly hugs the free end of the thick spring wire 2. The spring 17 here provides a secondary spring action and may frictionally grip wire 2 or can be soldered, welded or otherwise fixed at the free end of the coil spring to the wire w.

Figure 4:
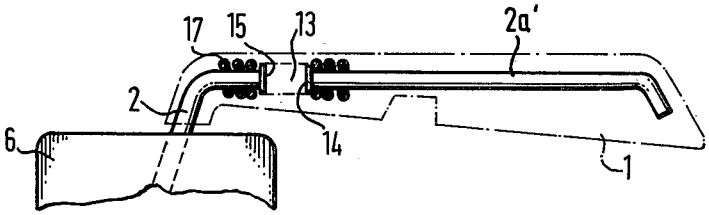
FIG. 4 is a fragmentary plan view of the transition between an actuator and the blade of a ski brake in which a coil spring bridges a gap between a wire extending into the blade and the actuator wire.

Another coil spring arrangement is shown in FIG. 4, in which the wire 2 is spaced from wire 2*a'*, both being of the same thickness, by a gap 13 bridged by the coil spring 17. The confronting ends 14 and 15 of the wires 2 and 2*a* may here by formed with plates receivable between turns of the coil spring 17 so that the spacing between the ends of the wires may be varied.

Of course, it is not essential that the spring-supported ends of the wires be embedded in the plates 1, since the blades may simply be fastened externally to these wires. Furthermore, other spring elements such as leaf springs can be substituted for the coil springs shown and described and can fasten the wire 2 to the blade 1.

I claim:

1. A ski brake for a ski comprising:

an actuator swingably mounted on an upper surface of said ski for pivotal movement about a transverse axis substantially parallel to said surface and engageable by a ski boot;

spring means bearing upon said actuator for biasing same into an operative position in which said actuator projects upwardly from said surface upon the release thereof by said ski boot;

at least one blade element connected to said actuator and displaceable thereby into a braking position in which said blade element lies transversely of the ski to prevent free flight of the ski upon release of said actuator by said ski boot, said blade element being in said braking position when said actuator is in said operative position; and elastic means interposed between said element and said actuator for cushioning forces applied to said spring means upon impact from any direction against said element.

2. The ski brake defined in claim 1 wherein said ski brake comprises a stirrup-shaped spring wire and said actuator is a substantially planar bight of said wire, and wherein said wire comprises said spring means, said wire having a pair of offset portions connected to said bight and lying in a plane different from the plane of said bight so that displacement of said bight toward said surface distorts said wire resiliently, a pair of such blade elements being provided, said elastic means including an elastic member for each blade element connected to a respective one of said offset portions.

3. The ski brake defined in claim 2 wherein each of said elastic members comprises a respective loop formed in said wire between the respective blade element and the respective offset portion.

4. The ski brake defined in claim 2 wherein each of said elastic members comprises at least in part a further wire thinner than said spring wire and connected to the respective blade element.

5. The ski brake defined in claim 4 wherein said spring and further wires are each connected by a respective sleeve.

6. The ski brake defined in claim 5 wherein each of said sleeves is composed of an elastic material.

7. The ski brake defined in claim 4 wherein each of said further wires is formed with a coil spring at an end thereof, said coil spring forming the respective elastic member and being connected to said spring wire.

8. The ski brake defined in claim 7 wherein said offset portions have respective free ends received in the respective coil springs.

9. The ski brake defined in claim 4 wherein the modulus of elasticity of the respective further wire is different from that of said spring wire.

10. The ski brake defined in claim 2 wherein said spring wire is subdivided and has ends spaced apart at a transition between said spring means and said element, said elastic member including a secondary spring bridging said free ends.

11. The ski brake defined in claim 10 wherein said secondary spring is a coil spring in which said free ends are received.

* * * * *

Disclaimer 4,078,826.—*Tilo Riedel,* Eching, Germany. SKI BRAKE WITH INCREASED RESILIENCY BETWEEN BRAKE ACTUATOR AND BRAKE BLADE. Patent dated Mar. 14, 1978. Disclaimer filed Mar. 2, 1981, by the assignee, *S. A. Etablissements Francois Salomon & Fils.*

The term of this patent subsequent to June 22, 1993, has been disclaimed.

[*Official Gazette April 7, 1981.*]